United States Patent [19]

Ueshima et al.

[11] Patent Number: 4,989,694

[45] Date of Patent: Feb. 5, 1991

[54] ELEVATOR GROUP SUPERVISORY SYSTEM

[75] Inventors: Takaaki Ueshima; Kenji Yoneda; Naobumi Nakata; Toshimitsu Tobita; Soshiro Kuzunuki, all of Katsuta; Yuzo Morita; Atsuya Fujino, both of Hitachi; Masato Suzuki, Ibaraki; Masachika Yamazaki, Katsuta, all of Japan

[73] Assignee: Hitachi, Ltd., Tokyo, Japan

[21] Appl. No.: 320,610

[22] Filed: Mar. 8, 1989

[30] Foreign Application Priority Data

Mar. 9, 1988 [JP] Japan ..... 63-53524
Nov. 7, 1988 [JP] Japan ..... 63-279340

[51] Int. Cl.[5] ..... B66B 3/00
[52] U.S. Cl. ..... 187/121; 187/135; 187/139
[58] Field of Search ..... 187/121, 124, 125, 126, 187/127, 130, 135, 137, 138, 139

[56] References Cited

U.S. PATENT DOCUMENTS

| | | | |
|---|---|---|---|
| 4,195,712 | 4/1980 | Kuhl | 187/121 |
| 4,431,086 | 2/1984 | Moser et al. | 187/125 |
| 4,520,905 | 6/1985 | Sasao | 187/127 |
| 4,691,808 | 9/1987 | Nowak et al. | 187/127 X |
| 4,724,933 | 2/1988 | Tsuji et al. | 187/137 |
| 4,852,696 | 8/1989 | Fukuda et al. | 187/139 |

*Primary Examiner*—Todd E. Deboer
*Assistant Examiner*—W. E. Duncanson, Jr.
*Attorney, Agent, or Firm*—Antonelli, Terry, Stout & Kraus

[57] ABSTRACT

The invention relates to call registration wherein of a plurality of elevators an elevator which a user (passenger) wants to ride is called to the elevator hall of the user. A display is provided at an elevator hall for users. When a user depresses a hall calling button, a group supervisory controller determines and selects a suitable elevator, and causes the condition of the elevator to be displayed on the display in the form of sentences or the like. If the user is satisfied with the selected elevator, the hall calling button is not actuated again. If the user is dissatisfied with the selected elevator, the hall calling button is depressed again so that the controller selects another elevator for service to the user.

20 Claims, 12 Drawing Sheets

FIG. 2

T1

| DATA NO. | DATA CONTENTS |
|---|---|
| 1 | ONE OR TWO MORE PASSENGERS CAN STILL RIDE IN THIS ELEVATOR |
| 2 | FIVE MORE PASSENGERS CAN STILL RIDE IN THIS ELEVATOR |
| 3 | TEN MORE PASSENGERS CAN STILL RIDE IN THIS ELEVATOR |
| 4 | THIS ELEVATOR IS NOT FOR SERVICE TO 1ST FLOOR |
| 5 | THIS ELEVATOR IS NOT FOR SERVICE TO WHEELCHAIRS |
| 6 | DEPRESS HALL BUTTON AGAIN IF THIS ELEVATOR IS NOT SUITABLE FOR YOU |

T2

| DATA NO. | DISPLAY DATA | DISPLAY DATA |
|---|---|---|
| 1 | NO PASSENGERS | FOR 10 PASSENGERS |
| 2 | NO PASSENGERS | FOR 10 PASSENGERS |
| 3 | NO PASSENGERS | |
| 4 | TO 1ST FLOOR | |
| 5 | 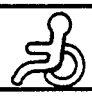 | |
| 6 | DEPRESS HALL BUTTON WHILE SELECTION CONDITON IS DISPLAYED | |

ELEVATOR GROUP SUPERVISORY SYSTEM

BACKGROUND OF THE INVENTION

The present invention relates to an elevator group supervisory system. More particularly the invention concerns an elevator call registration unit wherein an elevator satisfying the condition a user makes is called selectively from a plurality of elevators.

A conventional call registration unit of an elevator group supervisory system is constructed of a pair of up/down buttons. Upon actuation of the button, an elevator having the shortest waiting time is selected from a plurality of elevators, and a reservation lamp for the elevator is turned on.

A user is satisfied with an elevator having the shortest waiting time in most cases. However, a user is dissatisfied with such a elevator in the following cases.

(1) Although a user called an elevator so as to carry wagons in it, the assigned elevator is crowded so that the user cannot carry the wagons therein.

(2) At a building whose elevator system is arranged such that only some of the elevators are for service to the ground floor, if a user who wants to go to the ground floor is assigned an elevator not serviceable to the ground floor, then the user cannot go down to the ground floor in the responding elevator.

To deal with such cases, a specially mounted calling button has been proposed. This specially mounted calling button is provided in addition to the general calling button. Upon actuation of this special button, a certain elevator assigned to the button is called. As the buttons of this type, systems are known which have a button for calling an elevator dedicated to users of wheelchairs, a button for calling an elevator used by very important persons, a button for calling an elevator which is not-crowded, a button for instructing that a user wants to go to a floor to which only some of elevators are serviceable and the like (refer to Japanese Patent Laid-Open Publication JP-A-51-7653 and etc.).

With the above type of prior art system, a button becomes necessary for each special function so that a plurality of buttons for special functions must be provided at each elevator hall, resulting in an increase of wirings, controllers and installation cost.

To solve the above problems, there is disclosed in Japanese Patent Laid-Open Publication JP-A-59-114271 a system providing a special call command which is generated by employing a special operation method of a hall calling button (coded call unit).

However, users who do not know the special operation method cannot use the coded call unit. In addition, various functions are each designated by a combination of short and long operation times of a single button so that erroneous operation may increase.

Another prior art technique for an elevator group supervisory system is known which is capable of displaying general information such as events guidance at each floor, weather forecast and the like on a display mounted at the hall or within the elevator cage. Such a technique is disclosed, e.g. in Japanese Patent Laid-Open Publications JP-A-60-191977, JP-A-61-136887, JP-A-61-226479 and the like.

According to the prior art technique disclosed in JP-A-60-191977 and JP-A-61-136887, a display mode is selectively controlled whereby a message having an optimum length from the display start to the end is selected based on the waiting time, or the speed of scrolling a message is changed based on the waiting time. According to the prior art technique disclosed in JP-A-61-226479, the display information content is selectively displayed at each floor within the cage.

All of the above-described prior art techniques are characterized in that they provide mainly a method of displaying general information rather than operation information of an elevator. Apart from these techniques, another technique is disclosed, e.g. in Japanese Patent Laid-Open Publication JP-A-62-186707 wherein a display having a function to alternately display general information and the operation information of an elevator is provided and the operation information of an elevator is displayed with a priority over the general information under a predetermined condition.

The above-described prior art technique is effective as a method of announcing the operation information of an elevator and the general information. However, this technique does not positively change the control operation of an elevator in accordance with the announced information. A user cannot change the operation of an elevator by using the guidance information, thus posing a problem of actually effective display.

The following two U.S. patent applications assigned to the same assignee are related to elevator control systems.

Y. Morita et al. U.S. patent application Ser. No. 301,973 filed on Jan. 26, 1989 claiming priority based on Japanese patent application Nos. 63-16983, 63-16984, 63-47480, 63-51493 and 63-53532 filed on Jan. 29, 1988, Jan. 29, 1988, Mar. 2, 1988, Mar. 7, 1988 and Mar. 9, 1988, respectively.

K. Yoneda et al. U.S. patent application Ser. No. 330,376 filed on Mar. 1, 1989 claiming priority based on Japanese patent application No. 63-49536 filed on Mar. 4, 1988.

SUMMARY OF THE INVENTION

It is an object of the present invention to provide an elevator group supervisory system which is capable of calling an elevator satisfying a particular condition with a simple user operation, and running an elevator in accordance with the requirements (intention) of a passenger.

It is another object of the present invention to provide an elevator group supervisory system which permits a user to partially participate in controlling the operation of an elevator, e.g. in selectively determining a call assigned elevator and the like, in accordance with the guidance information.

It is a further object of the present invention to provide an elevator group supervisory system which is capable of quickly calling a serviceable elevator meeting certain user requirements.

An aspect of the present invention for achieving the above objects resides in that a display is provided in the elevator hall, the conditions for selecting a call assigned elevator are displayed which conditions are selectable by a user, and a unit for selecting the displayed conditions is provided.

The conditions selectable by a user include:

(1) a call for an elevator having a short waiting time;
(2) a call for an elevator dedicated to users of wheelchairs;
(3) a call for an elevator for very important persons;
(4) a call for an elevator not-crowded; and (5) a call for an elevator serviceable to a particular floor.

The conditions are sequentially displayed using characters and figures or symbols. Upon actuation of a hall calling button while the condition is displayed, an elevator satisfying the displayed condition is selected.

According to a modification of this invention, upon actuation of a hall calling button, an elevator having a short waiting time is immediately assigned and such effect is displayed. Thereafter, the operation information of the assigned elevator, e.g. (1) "Crowded" (2) "No service to ground floor" and the like, is displayed on a display for the assigned elevator. Then, a guidance information "If not satisfied, actuate hall button again" is given to re-select an elevator satisfying the conditions.

In quickly re-selecting an elevator meeting the user requirements, the so-called call assignment control for determining a serviceable elevator upon occurrence of a new hall call according to the present invention is constructed such that first and second assigned candidate elevators are discriminated, only if the discriminated first candidate elevator does not suffice the predetermined conditions, the control target values of the first and second candidate elevators are compared with each other, the compared results are presented to a user by means of a display, and thereafter a right to determine which elevator among the first and second candidate elevators is to be assigned is given to the user.

An operation control unit provided in a group supervisory controller has generally a function to select an elevator satisfying the predetermined control target values. However, depending upon the operation conditions of an elevator at a certain time, there occurs a case where an elevator not satisfying the predetermined control target values must be selected.

In view of the above, according to the present invention, two call assigned candidate elevators are discriminated instead of a single call assigned candidate elevator. A function to temporarily register the two elevators is provided, and in addition a message indicating that one of the two, temporarily registered, candidate elevators can be selected as desired is notified by using a guidance information display mounted at an elevator hall. If a user considers that the first call assigned candidate elevator may suffice, then it is not necessary for the user to perform any special operation. In this case, the first call assigned candidate elevator is actually registered after a predetermined time lapse. On the other hand, if the user wants to select the second call assigned candidate elevator, the user depresses the hall calling button once again to cause the second candidate elevator to be actually registered.

BRIEF DESCRIPTION OF THE DRAWINGS

FIG. 2 shows the structure of tables storing data to be displayed on the display HD at an elevator hall shown in FIG. 1;

DESCRIPTION OF THE PREFERRED EMBODIMENTS

An embodiment of the present invention will be described with reference to FIGS. 1 to 5.

Figure 1:
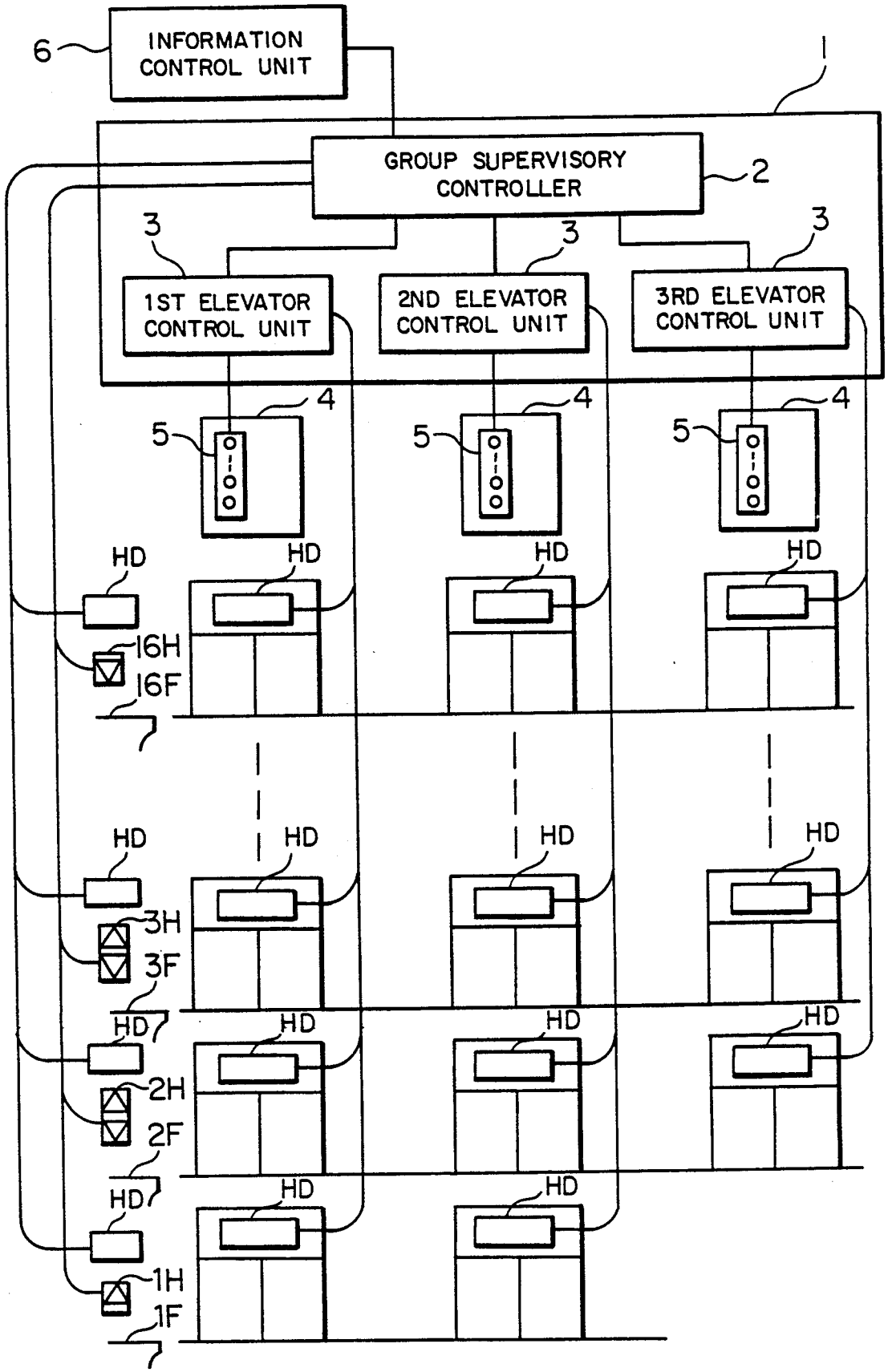
FIG. 1 is a schematic diagram showing the overall arrangement of an embodiment of the elevator group supervisory system according to the present invention.

FIG. 1 shows an overall arrangement of the elevator group supervisory system according to an embodiment of the present invention. For the purpose of brevity, the group supervisory system for three elevators is presented. It is assumed that first and second elevators serve the first to sixteenth floors, the third elevator serves the second to sixteenth floors, and the first elevator is used for wheelchairs only.

An elevator controller 1 is constructed of a group supervisory control unit 2 and three elevator control units 3. Each elevator control unit 3 receives a signal generated upon actuation of a cage calling button 5 mounted on the elevator cage 4, and sends it as well as an elevator position signal and an elevator direction signal to the group supervisory controller 2. The group supervisory controller 2 receives a signal generated upon actuation of each hall calling button 1H to 16H mounted on each floor 1F to 16F, selects one of the three elevators to send the signal thereto, and performs a guidance display. Hall displays HD are mounted near the hall calling button and above the elevator door at each floor. The group supervisory controller 2, elevator control units 3 and hall displays HD are controlled in a known manner using a microcomputer. Information transfer, designation of a hall display HD on which a guidance is displayed, and the like operation can be changed/added as desired depending upon the display control program contents. Registration of graphic/-character information to be displayed, and the display control program can be changed/added as desired under control of an information control unit 6.

FIG. 2 shows examples of table formats of data to be displayed on the hall display HD. The tables T1 and T2 in the form of IC cards, battery backed-up RAMs or the like store therein the information supplied from the information control unit 6. The table T1 stores data to be displayed upon call registration, whereas the table T2 stores data to be displayed upon re-selection. The table T1 will first be described. Data No. 1 to No. 3 are for the display of information "This elevator has still room for up to a certain number of people". Data No. 4 is for the information "This elevator does not go down to the 1st floor". Data No. 5 is for the information "This elevator does not serve for wheelchairs". Data No. 6 is for the information "Depress the button again if this elevator is not suitable for you". The table T2 will then be described. Data No. 1 and No. 2 are for the two graphic symbols for "No passenger" and "Capacity of 10 passengers". Data No. 3 is for the graphic symbol for "No passenger". Data No. 4 is for the graphic symbol for "Down to the 1st floor". Data No. 5 is for the graphic symbol for "Wheelchairs only".

Figure 3:
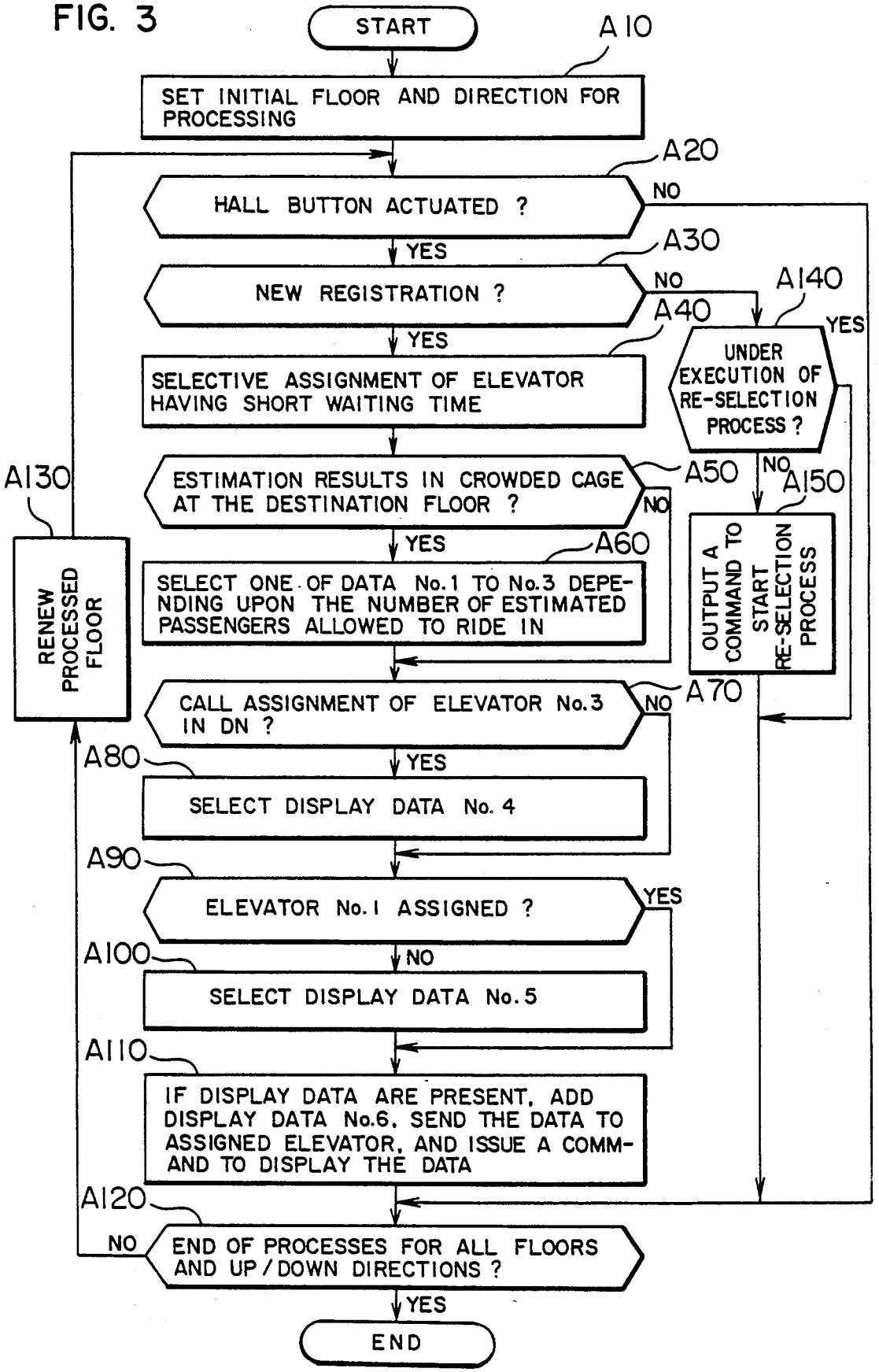
FIGS. 3 and 4 are software flow charts illustrating the operation of the group supervisory controller 1 shown in FIG. 1.
Figure 4:
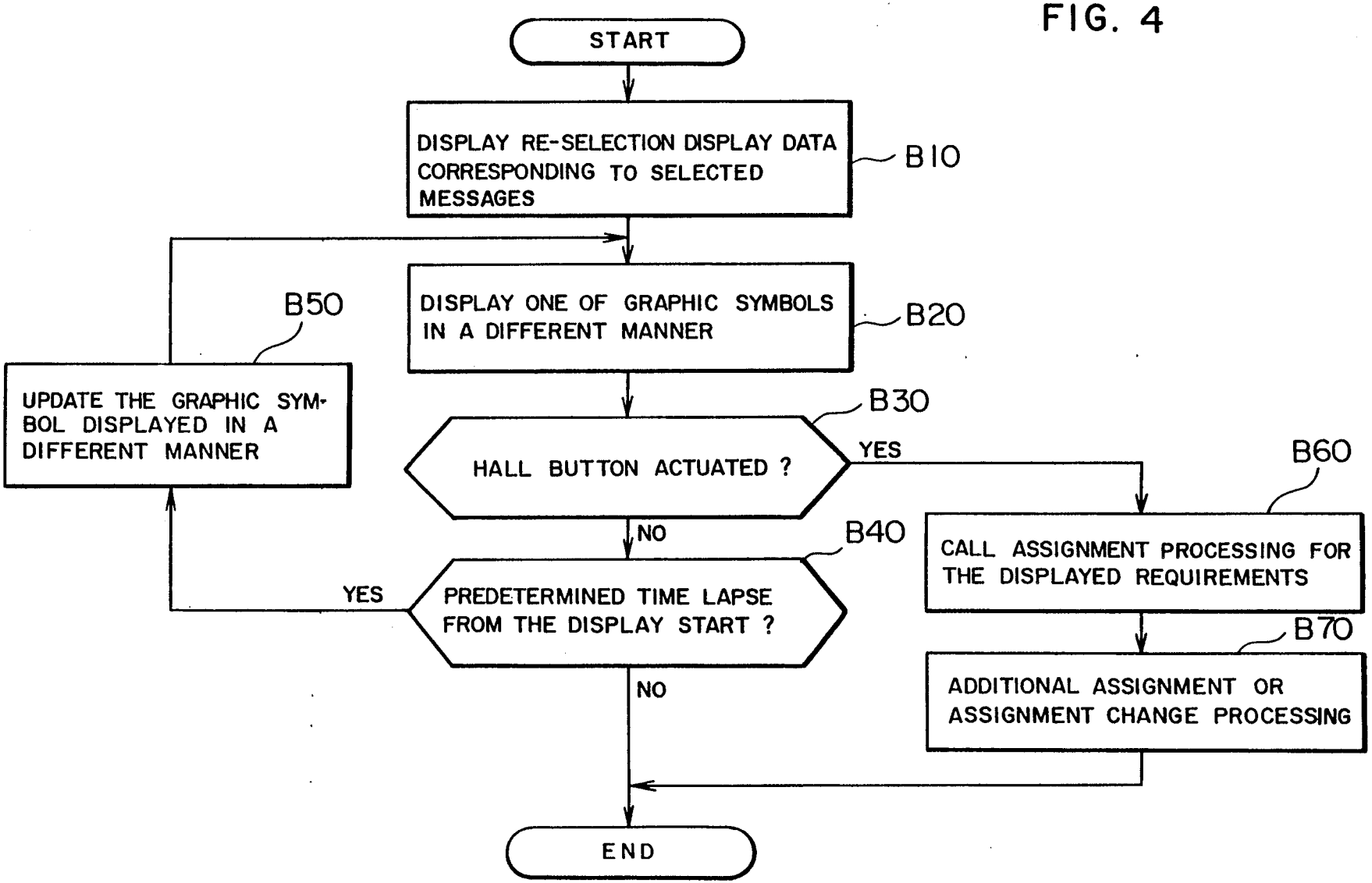

FIGS. 3 and 4 are flow charts illustrating the software function of the group supervisory controller according to the present invention.

The flow chart shown in FIG. 3 illustrates the program for checking the actuation of hall calling up/-down buttons at all the floors, this program being cyclically executed every 100 ms.

First, at step A10, a floor to be dealt first and the up/down direction are set. At step A20, it is checked if the hall calling button has been actuated. If not, the flow skips to step A120 to deal with the next floor. At step A30, it is checked if the hall call is a new one or not. If it is a newly registered hall call, then the processes at steps A40 to A110 are executed. If the hall calling button with its call already registered has been actuated again, the flow advances to step A140.

In the case of a newly registered call, first at step A40, an elevator having a shortest waiting time is selected and the assignment display is performed. At steps A50 and A60, the degree of crowded state of the elevator at the calling floor is estimated, and one of the display messages Nos. 1 to 3 is selected depending upon the number of passengers to be allowed to ride in the elevator. At steps A70 and A80, it is checked if the elevator No. 3 assigned is for running in the down (DN) direction. If affirmative, the display message No. 4 is additionally selected. At steps A90 and A100, it is checked if the assigned elevator is No. 1 or not. If not, the display message No. 5 is additionally selected. At step A110, it is checked if there is any display message selected at steps A60, A80 and A100. If one or more display messages have been selected, the display message No. 6 is additionally selected. The selected information is sent to the elevator control unit to display it on the hall display. Various displays are possible by the processes at steps A40 to A110. For instance:

(1) In the case where the elevator No. 3 is assigned upon a DN call from the 9th floor, and it is estimated that two or three passengers will be allowed to ride in the elevator at the calling floor, then the display messages as selected are No. 1, No. 4, No. 5 and No. 6 which are displayed in a scrolled manner on the hall display at the 9th floor.

(2) In the case where the elevator No. 2 is assigned upon a DN call from the 9th floor, and it is estimated that 10 passengers will be allowed to ride in the elevator at the calling floor, then the display messages as selected are No. 3, No. 5 and No. 6 which are displayed in a scrolled manner on the hall display at the 9th floor.

(3) In the case where the elevator No. 1 is assigned upon a DN call from the 9th floor, and it is estimated that the number of passengers in the elevator cage will be zero at the calling floor, then there is no display message to be selected. In this case, only the assignment display is made on the hall display at the 9th floor.

If the hall calling button with its call already registered has been actuated again, then step A140 follows whereat it is checked if a re-selection process is now being executed or not. If not, a start command for a re-selection process is outputted at step A150.

FIG. 4 is a flow chart illustrating the re-selection process.

The operation will be described using a particular case by way of example where a passenger who wants to go down to the 1st floor actuates the hall button, under the condition that the elevator No. 3 was assigned upon a DN call from the 9th floor by the passenger and the messages No. 1, No. 4, No. 5 and No. 6 are now selectively displayed, as described with the flow chart of FIG. 3.

Figure 5:
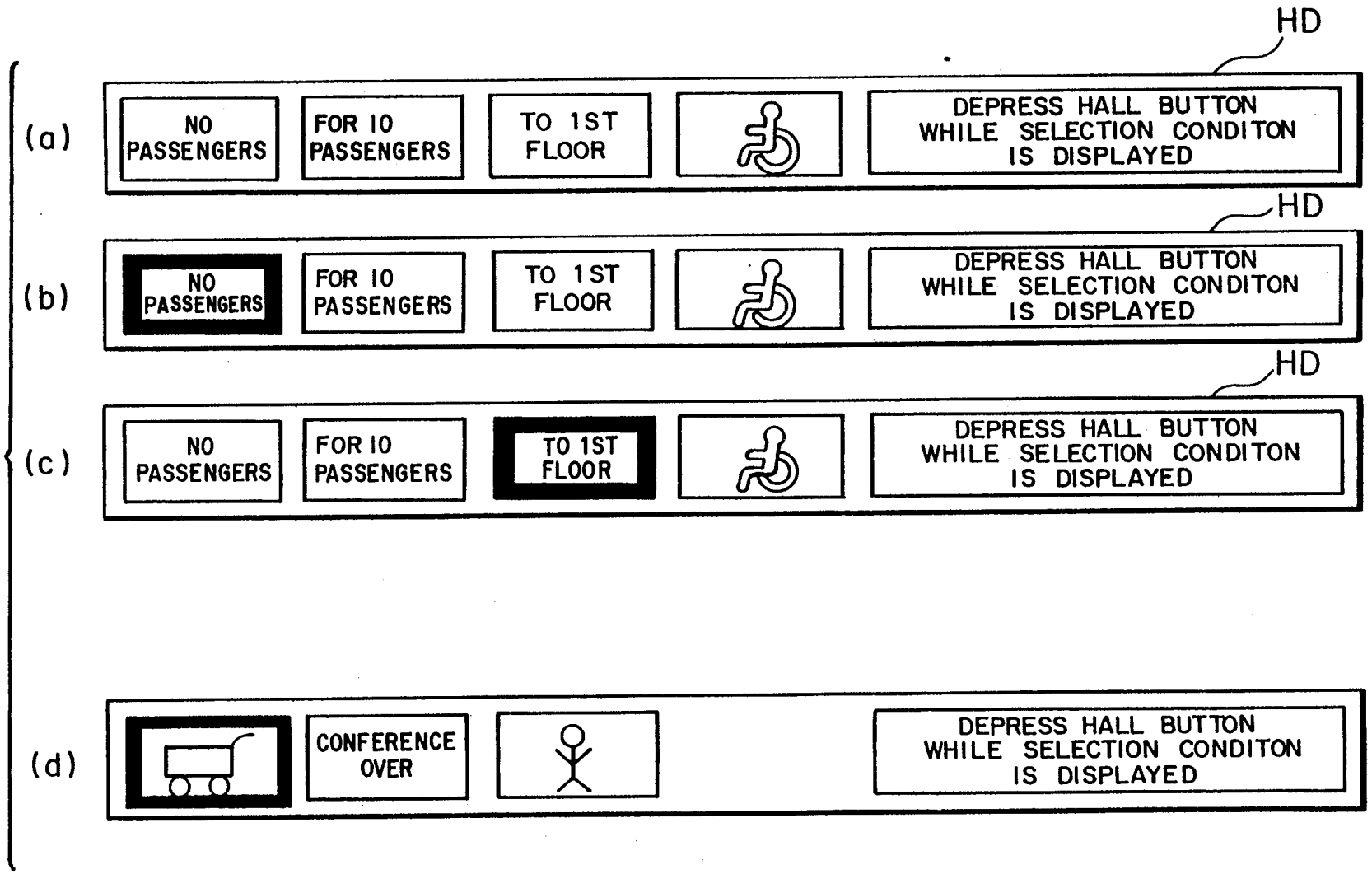
FIG. 5 shows the display contents on the display HD at an elevator hall shown in FIG. 1.

First, upon actuation of the hall button, the re-selection display data corresponding to the selected messages are selected from the table T2 and displayed on the hall display, as shown in FIG. 5(*a*), at step B10. At step B20, one of the graphic symbols is displayed in a different manner from the other graphic symbols. In this embodiment, one of the graphic symbols is made to flicker, as shown in FIG. 5(*b*). At step B30, it is checked if the hall button has been actuated. If actuated, the flow advances to step B60. If not, the flow advances to step B40 whereat the lapsed time from the start of displaying is checked. If the same display continues over a predetermined time, then the flow advances to step B50 whereat the graphic symbol displayed in a different manner is renewed to return to step B20, which is shown in FIG. 5(*c*). If the display continues for less than the predetermined time, the processes terminate. At step B60, a call assignment process corresponding to the graphic symbol now being displayed is executed. According to this assignment process, when the passenger who wants to go down to the 1st floor depresses the hall button during the time when the graphic symbol shown in FIG. 5(*c*) is displayed, one of the elevators No. 1 and No. 2 which serves the 1st floor is determined. At step B70, an additional assignment or assignment change is carried out with respect to the selected elevator, to thus complete the processes.

In the above embodiment, if only one message is displayed, e.g. if the message "This elevator does not go down to the 1st floor. Depress the hall button again if this elevator is not suitable for you." is displayed, and if the hall button is depressed during display, then it is not necessary to be notified of the dissatisfied reason. Therefore, it is obvious that the process at step B60 shown in FIG. 4 may directly be executed.

For those buildings or hotels where there are many occasions of carrying wagons in a private elevator for employees, or of calling a through elevator for room services, the processes for selecting an elevator with short waiting time and, if not satisfied, reselecting the call assignment as shown in FIG. 3 may be omitted. Instead, the conditions for assigning an elevator are caused to be displayed at any time.

Further, if the conditions selectable by a passenger are limited to one condition (e.g. (1) the degree of crowded state is displayed only if a crowded elevator is selected, (2) the message that this elevator does not go to a certain floor is displayed only if such an elevator is selected), it is advantageous in that an elevator satisfying the condition can be re-selected immediately upon actuation of the hall calling button.

Furthermore, not only the selection conditions for an elevator can be directly designated based on the display contents of the data table T2 shown in FIG. 2 at the time of re-selection, but also they can be indirectly designated by instructing the hall conditions such as shown in FIG. 5(*d*) including (1) carrying wagons, (2)

the meeting at the major conference hall is over, and (3) one passenger only will use an elevator.

According to the present invention, hall displays are provided at each floor to display thereon the conditions of an assigned elevator selectable by a passenger, and a selection device for selecting the conditions is provided. Therefore, even a passenger not accustomed to elevator operation can call an elevator which satisfies a particular condition or conditions, thus allowing various types of passenger requirements to be met.

According to the present invention, hall displays are provided at each floor to display thereon the operation information of an assigned elevator, and the assignment conditions are adapted to be re-selected. Therefore, if a currently assigned elevator does not suffice passenger's requirements, a re-selection is carried out to call another elevator which suffices the requirements.

As described with reference to FIG. 4, a passenger can ride in an elevator meeting the requirements by means of re-selection. If another elevator is selected at the time of re-selection, the registration of the elevator delays correspondingly, thus giving inconvenience to the passenger from the standpoint of quick response to a call.

In consideration of the above in the next embodiment, an elevator group supervisory system will be described wherein the next elevator can be registered at once at the time of re-selection.

The embodiment of such an elevator group supervisory system of this invention will be described with reference to the accompanying drawings.

Figure 6:
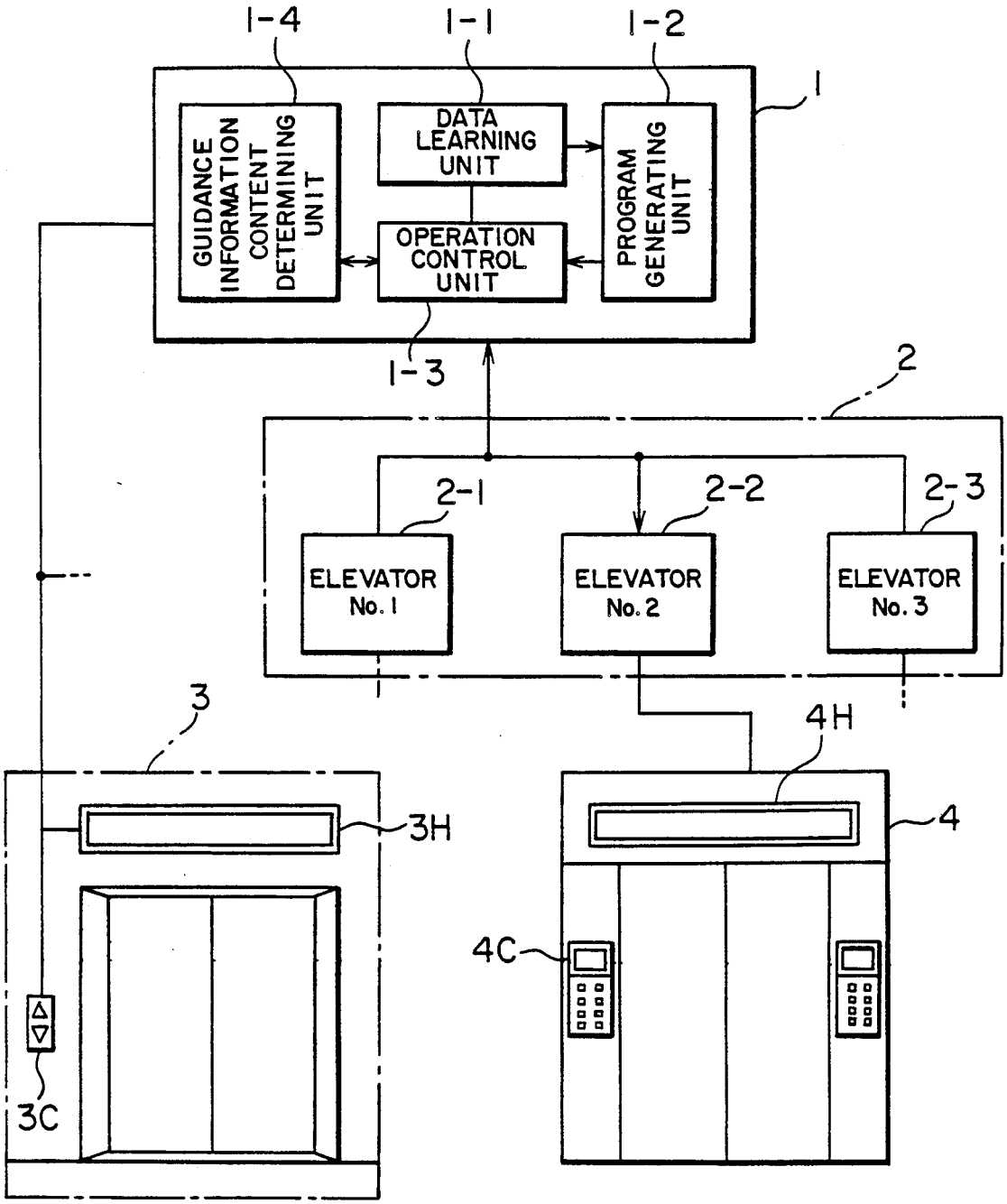
FIG. 6 is a schematic diagram showing the overall arrangement of another embodiment of the elevator group supervisory system according to the present invention.
Figure 8:
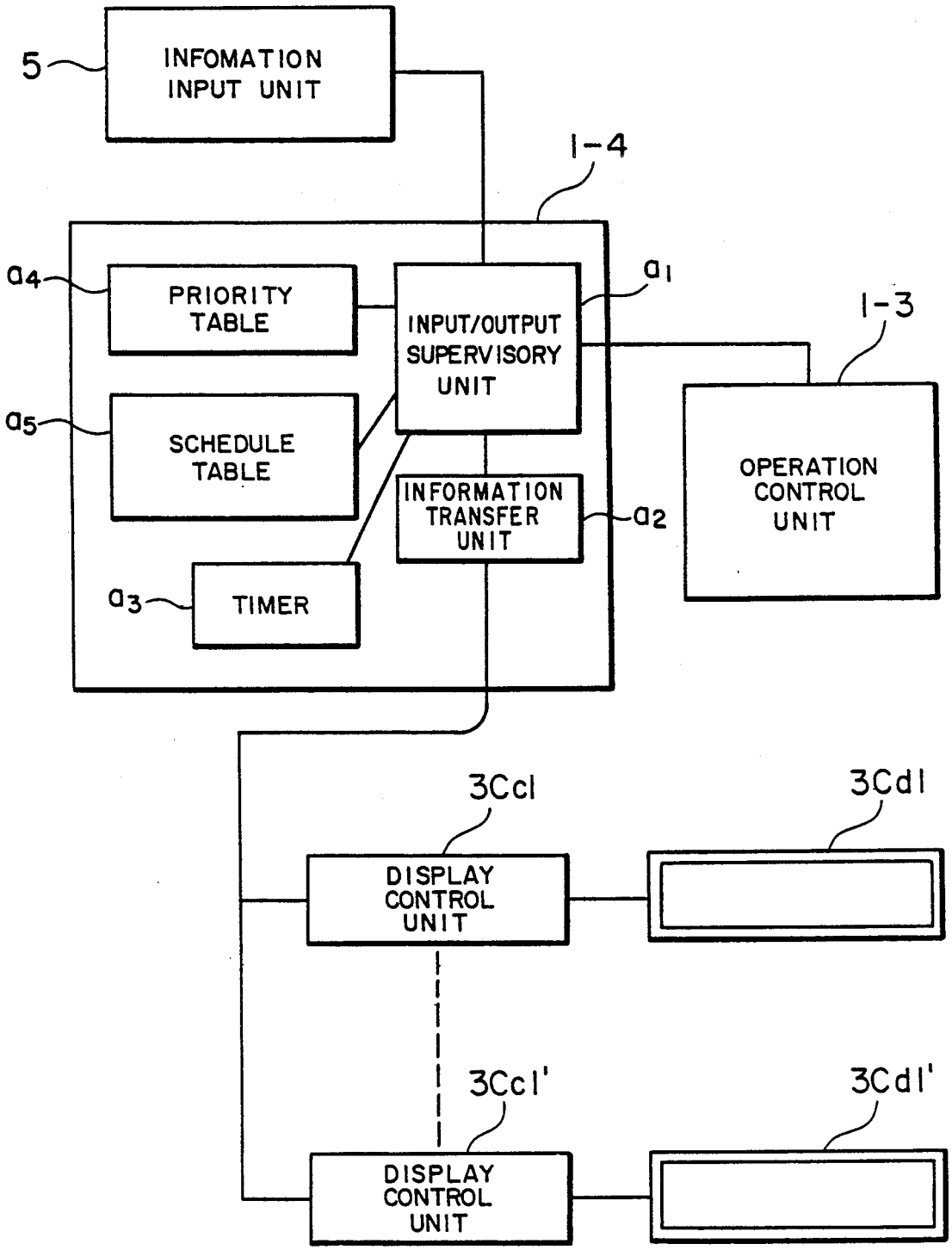
FIG. 8 is a block diagram showing the structure of the guidance information content determining unit shown in FIG. 6.
Figure 9:
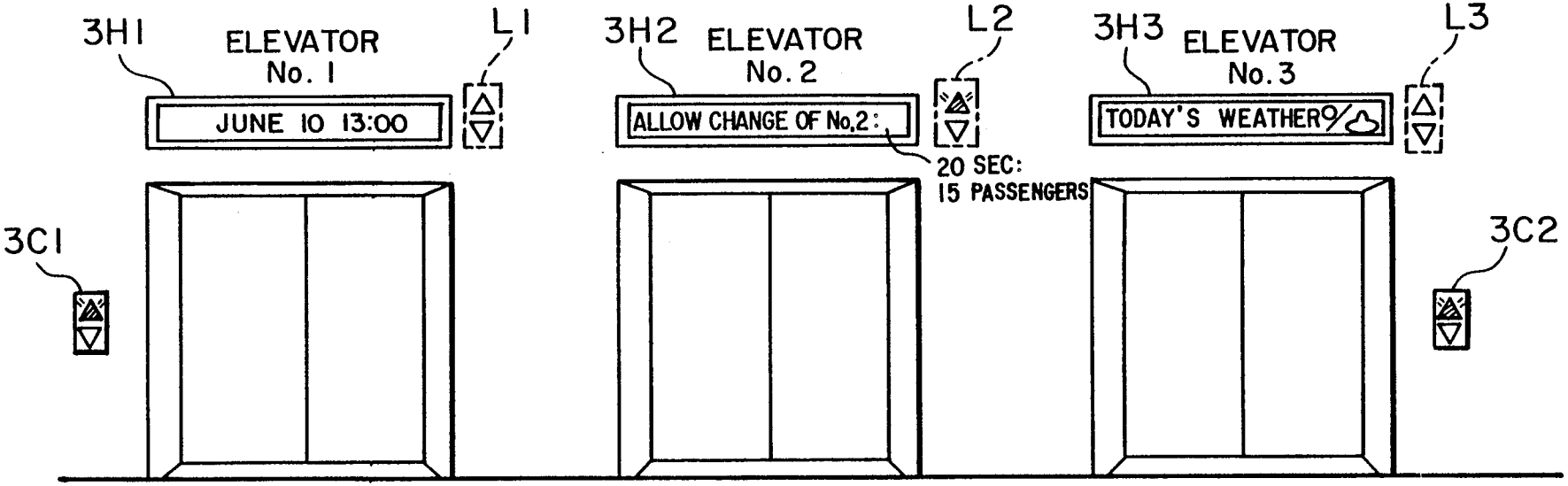
FIG. 9 illustrates an example of the guidance information at the new hall calling floor according to the embodiment shown in FIG. 6.

Referring to FIGS. 6, 8 and 9, reference numeral 1 denotes a group supervisory controller, 1-1 a data learning unit, 1-2 a program generating unit, 1-3 an operation control unit, 1-4 an announced information content determining unit, 2-1 to 2-3 (generally indicated at 2) an elevator control unit, 3 an elevator hall, 3C, 3C1 and 3C2 a hall calling button, 3H, 3H1 to 3H3, 4H a guidance information display, 3Cc1 and 3Ccl' a display control unit, 3Cd1 and 3Cd1' a display, 4 an elevator cage, 4C a cage calling button, and 5 an information input unit.

Referring now to FIG. 6, the elevator group supervisory system according to this embodiment of the invention is constructed of the hall calling button 3C, the group supervisory controller 1 for selecting an elevator for service to a calling hall and issuing a command to a selected elevator control unit 2-1 to 2-3 in response to a signal from the hall calling button 3C and in response to a signal from each elevator control unit 2-1 to 2-3, the guidance information display 3H and 4H mounted at each elevator hall and within each cage, and other elements. The group supervisory controller 1 is constructed of the data learning unit 1-1, program generating unit 1-2, operation control unit 1-3 and guidance information content determining unit 1-4, each functioning as in the following manner.

The data learning unit 1-1 receives various data such as a signal from the hall calling button 3C, signals representative of the position, running direction, number of riding-in/out passengers, and cage calling signals of the elevators from the elevator control units 2-1 to 2-3. The received data are statistically processed by the data learning unit 1-1 to generate a table containing the current data to be used by the operation control unit 1-4. The statistically processed data is eventually determined through simulation using the operation method, call assignment method and parameters used by the program generating unit 1-2 and operation control unit 1-3. The determined result is recorded in a control data table provided in the operation control unit 1-3.

The operation control unit 1-3 discriminates a current passenger flow or a current hour in a daily schedule to thereby retrieve the control method corresponding to the discriminated current passenger flow or the current hour from the control data table, and controls the operation of an elevator in accordance with the retrieved method. On the other hand, the program generating unit 1-2 determines the elevator operation method, call assignment method and parameters which satisfy a plurality of control target values set by an external input unit. The operation control unit 1-3 also determines if the determined assignment result satisfies the control target values, and selects a second call assigned candidate elevator if an elevator which does not satisfy the target values is selected. If the target values are substantially satisfied or if the estimated arrival time of the elevator is within a predetermined range, the operation control unit 1-3 does not select the second call assigned candidate elevator, but actually registers the previously selected elevator and instructs the assigned elevator to be of service to the hall calling floor (to stop at the calling floor).

If the second call assigned candidate elevator is selected, the operation control unit 1-3 records the first and second call assigned candidate elevators in a temporary registration table. At the same time, a reservation guidance lamp of the first call assigned candidate elevator is made to turn on, and a response lamp mounted at the side of the hall calling button 3C is made to flicker. In addition, the guidance information content determining unit 1-4 is caused to select a guidance information message indicating that the first call assignment candidate elevator can be changed, the message being displayed on the guidance information display 3H mounted at each floor for that elevator. If a passenger depresses again the hall calling button 3C while the message indicating that the elevator can be changed or while the response lamp flickers, then the operation control unit 1-3 actually registers the second call assigned elevator. If a passenger does not again depress the hall calling button 3C, the first call assigned candidate elevator is actually registered. A call selection button made of a touch panel or the like may be mounted in addition to the hall calling button so that a passenger who wants to change the assigned elevator can actuate the call selection button.

According to the embodiment system as described above, a passenger can determine which one of the first and second call assigned candidate elevators is to be selected, thus allowing more handy method for use.

The operation of the embodiment will be described more in detail.

Figure 7:
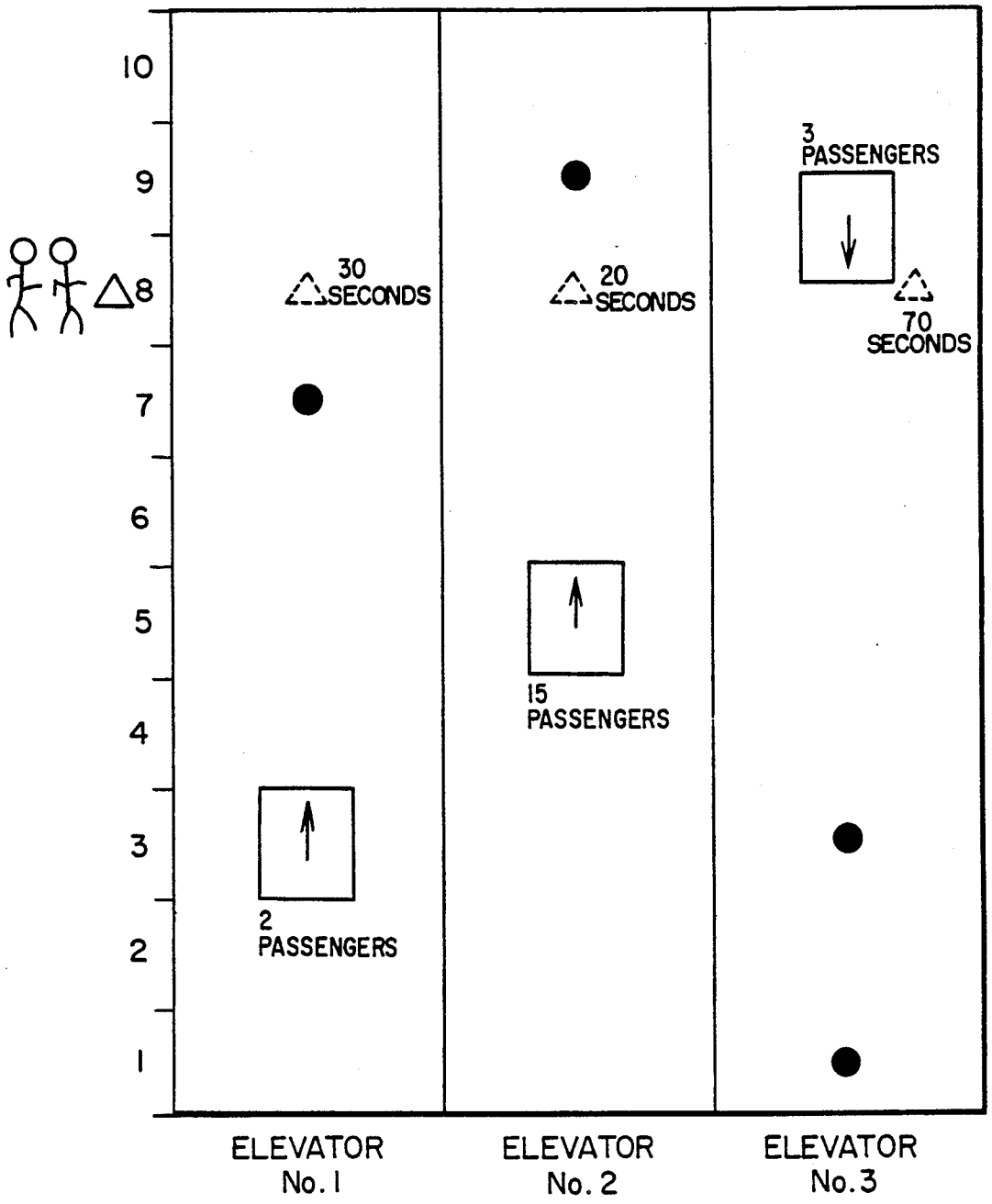
FIG. 7 shows an example of the operation state of elevators at a certain time.

FIG. 7 shows an example of the position, running direction and call state of three elevators No. 1 to No. 3 controlled by a single group supervisory controller. The following description will be directed to such a case.

The principal specification of the elevator group supervisory system shown in FIG. 7 is assumed that the capacity of each elevator cage is 20 passengers, the guidance information display is mounted at each elevator hall, and the main control target values at the current hour in the daily schedule are average waiting time less than 25 seconds and the degree of crowded state in a cage less than 40%. It is also assumed that the control target values are arranged in the priority order of the average waiting time, the degree of crowded state in a cage, and the like in this order.

In the example shown in FIG. 7, it is assumed that the method is applied whereby upon generation of a new hall call at the 8th floor, the waiting time, ride-in time, cage crowded state degree and the like are evaluated for each elevator to obtain total evaluation values weighted in accordance with the priority order of the control target values, and the elevator having the smallest evaluation value is selected. Examples of the evaluation equations are given by:

$$\phi_K = a_1\phi_{tK} + a_2\phi_{wK} + a_3\phi_{pK} + \quad (1)$$

$$\phi_K^* = \min(\phi_1, \phi_2, \ldots \ldots \phi_k) \quad (2)$$

In the above equations (1) and (2), $\phi_K$ represents an evaluation index of elevator No. K, $\phi_{tK}$ represents an evaluation value for the waiting time for elevator No. K, $\phi_{wK}$ is an evaluation value for the ride-in time for elevator No. K, $\phi_{pK}$ represents an evaluation value for the cage crowded state degree for elevator No. K, and $a_1$, $a_2$, $a_3$ ... are weighting coefficients of respective evaluation values the total sum of which is given by $$a_1 + a_2 + a_3 + \ldots \ldots + a_n = 1$$

where n represents the number of target items. Uniformly normalized evaluation values are used for respective control target items. $\phi_K^*$ represents the evaluation value of a selected elevator. Various methods of calculating the evaluation values for each control target have been proposed. In this embodiment, suitable methods are selectively used depending upon the circumstance and the detailed description therefor is omitted.

For the elevator selected in accordance with the evaluation equations, the higher priority control target value and an estimated value are compared with each other. If the estimated value is different from the target value by more than a predetermined value, the selected elevator is used as the first hall call assigned candidate elevator. The second hall call assigned candidate elevator is selected from the other elevators based on the evaluation results by the equations (1) and (2).

Specifically, in the example shown in FIG. 7, it is assumed that the elevator No. 2 is selected as the first hall call assigned candidate elevator. In this case, as seen from FIG. 7, the cage crowded degree of the elevator No. 2 is 75% which is in great excess of the target value of 40%. Therefore, a selection command for the second hall call assigned candidate elevator issues to select it. Thus, in the example shown in FIG. 7, the elevator No. 1 is selected as the second hall call assigned candidate elevator. The selection result is sent to the guidance information content determining unit 1-4.

Referring to FIG. 8, the guidance information content determining unit 1-4 is constructed of an input/output supervisory unit $a_1$, information transfer unit $a_2$, timer $a_3$, priority table $a_4$, and schedule table $a_5$.

The information such as the above-described selection result and the like from the operation control unit 1-3 is sent to the input/output supervisory unit $a_1$ where it is determined which message is to be displayed on the guidance information display for which elevator at which floor. The timer $a_3$ is used to supervise the display time duration, scrolling time duration and the like of the message. The priority table $a_4$ and schedule table $a_5$ in the guidance information content determining unit 1-4 store the information including the display messages, moving images and the like previously generated in accordance with the signals inputted from the information input unit 5. The priority table $a_4$ stores therein the display contents of the guidance information arranged in the priority order. The schedule table $a_5$ stores therein the instructions to display, at predefined times, the contents of the table on the displays at the hall and within the cage of the elevators not assigned a hall call.

In the embodiment shown in FIG. 7, when the operation control unit 1-3 selects two call assigned candidate elevators and temporarily stores them, the input/output supervisory unit $a_1$ receives the temporary registration command and the information necessary for display, determines the display contents based on the information, and sends via the information transfer unit $a_2$ an instruction to display the determined display content at the corresponding hall. In accordance with the instruction from the information transfer unit $a_2$, the guidance information is recorded in the display control unit 3Cc1 constituting the guidance information display 3H at the hall, and the display screen data for the guidance information is displayed on the display 3Cd1.

Examples of displayed contents at the 8th floor for each elevator are shown in FIG. 9. As appreciated from FIG. 9, a message indicating that an assignment can be changed is displayed on the guidance information display 3H2 of the elevator No. 2 which is the first call assigned candidate elevator. On the other hand, on the guidance information displays 3H1 and 3H3 of the other elevators, the general information such as present date and time, weather forecast and the like are displayed. Of the reservation lamps L1 to L3, only the lamp L2 of the first call assigned candidate elevator is maintained turned on to thus draw attention of passengers. The hall calling buttons 3C1 and 3C2 at this floor are made to flicker, which indicates that the call assignment ca be changed.

Figure 10:
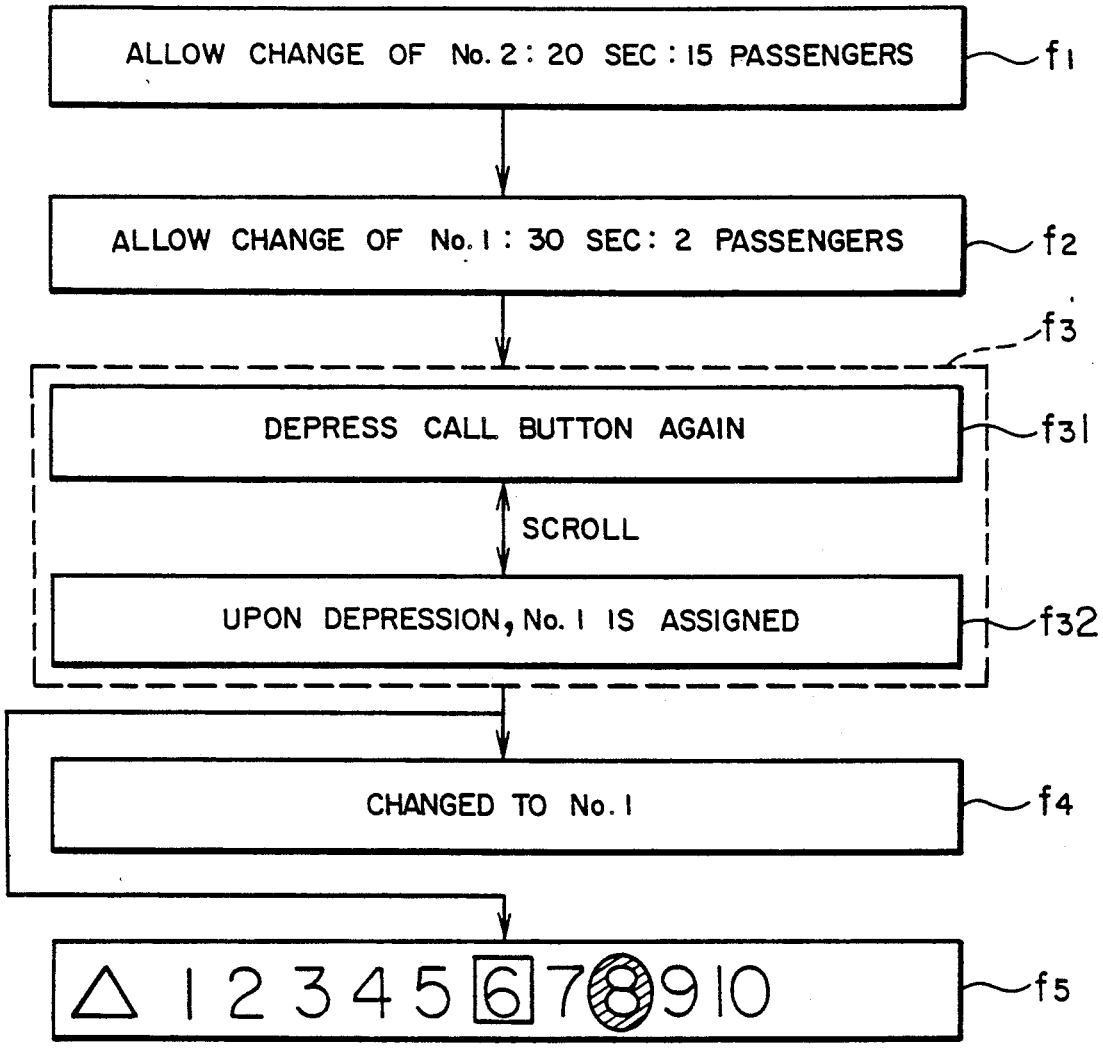
FIG. 10 shows an example of the guidance message according to the embodiment shown in FIG. 6.

Examples of display contents of the guidance information display 3H2 of the elevator No. 2 selected as the first call assigned candidate elevator are shown in FIG. 10.

Specifically, a message indicating that the assigned elevator can be changed, as well as the estimated values of the higher priority order for the control target values of the elevator, are displayed as indicated by f1. Next, the estimated values for the second call assigned candidate elevator are displayed as indicated by f2. Then, a message as indicated by f3 is displayed to announce that the elevator No. 1 selected as the second call assigned candidate elevator can be assigned upon depression of the hall calling button once again. In this display example, since the display message is long, it is displayed while scrolling in the horizontal or vertical direction as indicated by f31 and f32. If a passenger requests to change the call assignment and depresses the hall calling button once again, the message indicating the first assigned elevator has been changed to the elevator No. 1 is displayed as indicated by f4. If there is no request to change the call assignment, the display serving as an ordinary indicator presents the contents as indicated by f5.

The guidance messages shown and described as above have been used as the examples for description of the embodiment of the present invention. Various modifications and changes of the contents of messages are possible. The above messages have been used as being visually recognized. However, audible guidance apparatus may be used to conduct the similar guidance.

As described above, using the guidance information display of this embodiment allows the elevator control such as selecting an elevator by partially matching the requirements of a passenger, thus allowing more handy method for use.

The control target values are preset in accordance with an owner of a building or an intention of a building supervisor. Therefore, the values may sometimes be set as far from the passenger's requirements. However, as described so far, the right to select an elevator is given to passengers so that the elevator control considering a passenger's choice is allowed.

Figure 11:
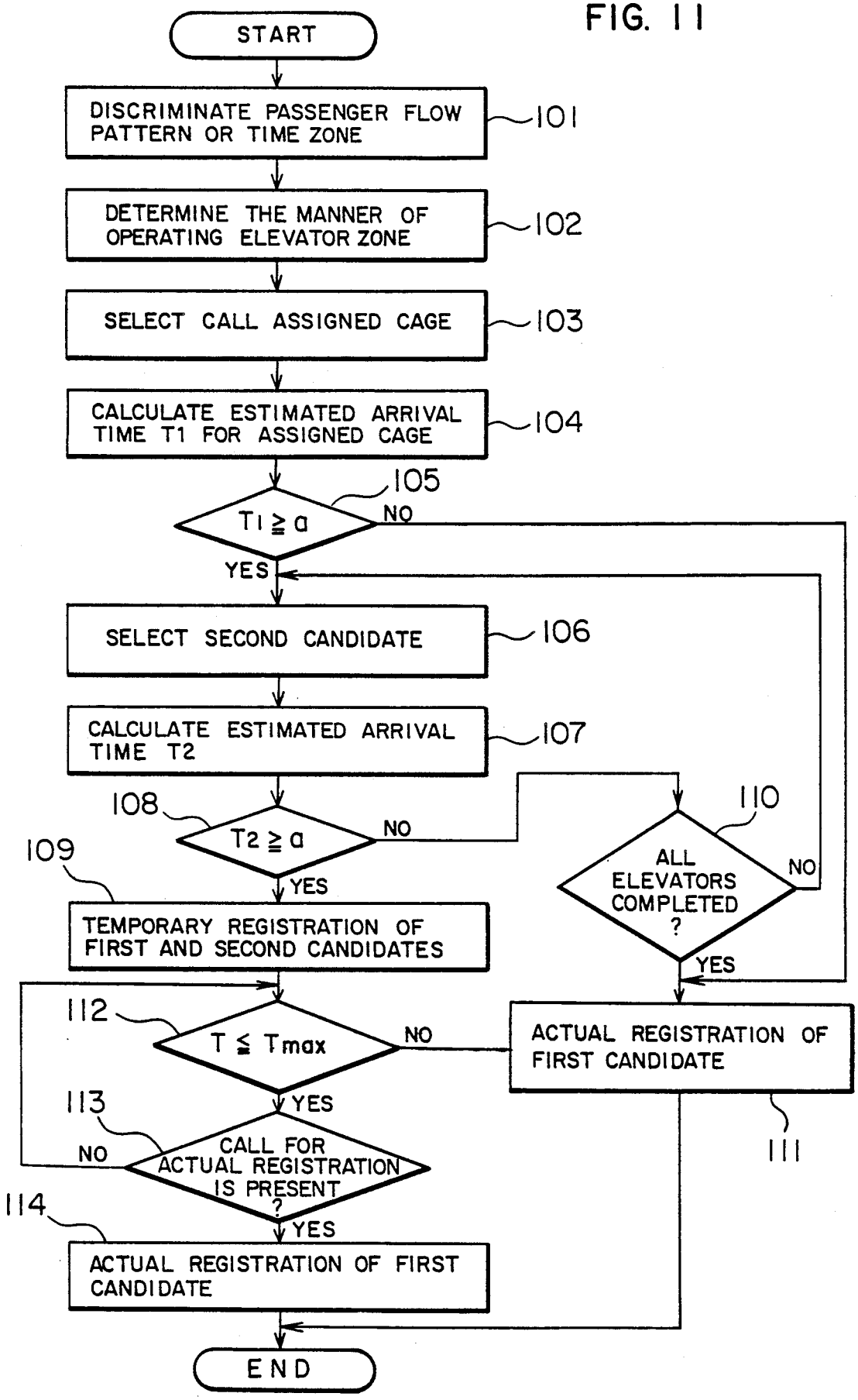
FIG. 11 is a flow chart illustrating the operation of call assignment according to the embodiment shown in FIG. 6.

Next, the operation by the operation control unit 1-3 will be described with reference to the flow chart shown in FIG. 11.

(1) First, there is discriminated a passenger flow pattern generated by the data learning unit 1-1 (the pattern is generated based on the data picked up for five minutes prior to occurrence of a hall call), or a passenger flow at a particular hour of the daily schedule if the present time is the hour while the passenger flow changes considerably (Step 101).

(2) Next, the operation method matching the passenger flow pattern discriminated at Step 101 is determined using the control data table generated by the program generating unit 1-2 (Step 102).

(3) Then, by using the elevator selection method and parameters stored in the control data table, a call assigned candidate elevator is selected, and an estimated arrival time T1 of the elevator to the calling floor is obtained (Steps 103 and 104).

(4) It is judged if the estimated arrival time T1 obtained at Step 104 is not shorter than a predetermined value a (value at which a call assignment can be changed) (Step 105).

(5) If the judgment at Step 105 indicates a shorter time than the predetermined value, then the selected elevator is actually registered (Step 111).

(6) If the judgment at Step 105 indicates a time not shorter than the predetermined value, then a second call assigned candidate is selected, and the estimated arrival time T2 of the elevator to the calling floor is obtained (Steps 106 and 107).

(7) It is judged if the estimated arrival time T2 obtained at Step 107 is not shorter than the predetermined value a (Step 108).

(8) If the judgment at Step 108 indicates a shorter time than the predetermined value, then it is checked if the other elevators still not selected are present. If not, the first call assigned candidate elevator is actually registered (Steps 110 and 111).

(9) If the check result at Step 110 is affirmative, then another second call assigned candidate elevator is selected (Steps 110 and 106).

(10) If the judgment at Step 108 indicates a time not shorter than the predetermined value, the first and second call assigned candidate elevators are registered in the temporary registration table (Step 109).

The registration results at Step 109 are sent from the operation control unit 1-3 to the guidance information content determining unit 1-4 for determination of the guidance information.

(11) At Step 112, the maximum time for allowing an arrival of the elevator temporarily stored at Step 112 having a shorter estimated arrival time is obtained, e.g., where T1 is smaller than or equal to T2, $T_{max}=T1-a$. The maximum time is compared with a lapsed time. If no operation is conducted until the lapsed time exceeds the maximum time Tmax, the assigned candidates are actually registered (Step 111).

(12) If the lapsed time is not still in excess of the maximum time Tmax at Step 112, it is judged if the second call assigned candidate elevator is requested to be actually registered (Step 113).

(13) If there is a request at Step 113, then the second call assigned candidate elevator is actually registered (Step 114). If not, the flow repeats the processes at Step 112 and the following steps as the time lapses.

Figure 12:
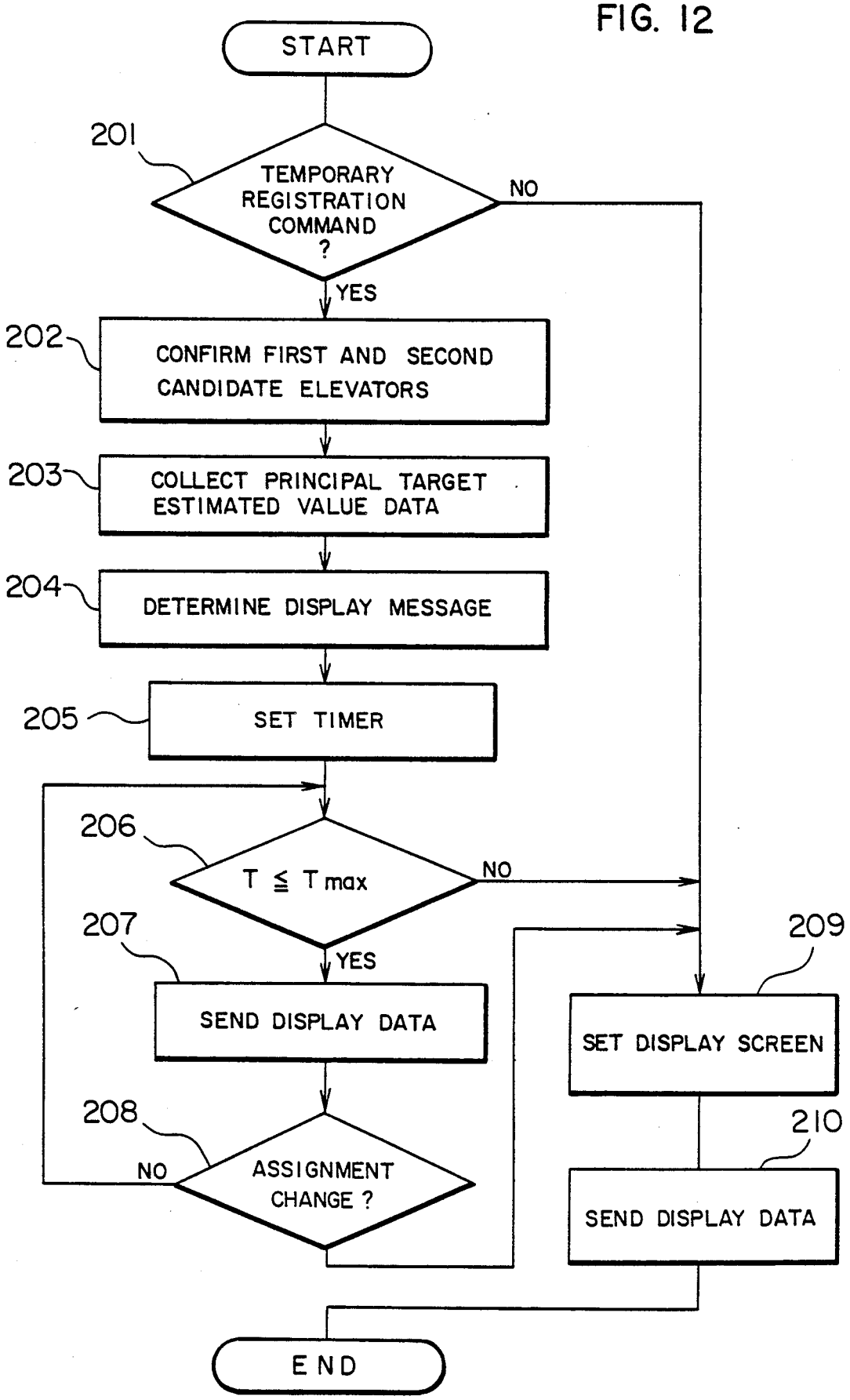
FIG. 12 is a flow chart illustrating the operation to determine the guidance information upon input of a temporary assignment signal according to the embodiment shown in FIG. 6.

Thereafter, the guidance information determining unit operates as in the following in accordance with the flow chart shown in FIG. 12.

(1) First, it is judged if the information supplied from the operation control unit 1-3 is a temporary registration command signal or not (Step 201).

(2) If the judgment at Step 201 indicates an ordinary actual registration command, the display is selectively determined so as to display the conditions of the call assigned elevator on the guidance information display at the calling floor (Step 209).

(3) If the judgment at Step 201 indicates a temporary registration command, the elevator numbers of the first and second call assigned candidate elevators are read, and the principal estimated target value data are collected (Steps 202 and 203).

(4) Next, in accordance with the data collected at Step 201, the messages to be displayed on the guidance information display of the first call assigned candidate elevator are selectively determined. The messages include a message indicating that the assignment can be changed, the estimated values for the principal control target values of the first and second call assigned candidate elevators, a message indicating a method of changing the assignment to the second call assigned candidate elevator, and the like. Then, the timer is set based on the above-described time duration during which the assignment can be changed (Steps 204 and 205).

(5) By the time the timer counts up its limit, the messages selectively determined at Step 204 are sent to the display control unit at the calling floor, and it is judged if the hall calling button has been actuated to change the assignment (Steps 206 to 208).

(6) If the timer counts up its limit at Step 206, then the display at the guidance information display for the first call assigned candidate elevator is newly determined. For instance, if the first call assigned candidate elevator per se is actually registered, the display screen is set so as to announce the elevator conditions such as its position and running direction (Steps 206 and 209).

(7) If the assignment is changed to the second call assigned candidate elevator, the display representative of such effect is displayed on the side of the first call assigned candidate elevator and thereafter, the general guidance information is selectively determined to be displayed. The display screen is selectively determined so as to display the elevator conditions such as its position and running direction on the guidance information display for the second call assigned candidate elevator (Steps 208 and 209).

(8) During the time when a hall call is valid, at the calling floor now concerned, the display data is sent to the display control unit to display them on the guidance information display, to then complete the processes (Step 210).

In the above embodiment, the guidance information display have been described as being, provided for each elevator. However, the present invention is also applicable to the case where a single guidance information display is provided at each elevator hall. This arrangement also enjoys the similar functions as described heretofore. Further, although two elevators have been made selectable, two or more elevators may be assigned as selectable.

According to the embodiment of the present invention, provision of the guidance information display enables to notify the elevator operation in accordance with the control (selection of call assigned elevator) conditions. Passengers can know the condition of the next candidate elevator beforehand and select the assigned candidate elevator. Thus, if a passenger wants to take a not-crowded elevator irrespective of a longer waiting time, the passenger can take such an elevator, thus allowing handy method for use.

According to the prior art, if a call assignment with prominence given to the waiting time is employed, a passenger is allowed to select only an elevator with a shortest waiting time even if it is crowded. If the passenger wants to take a not-crowded elevator, the passenger is compelled to call the next elevator without riding in the crowded elevator. Thus, the crowded elevator stops in vain at the hall so that the passengers in the elevator takes a longer time to the object floor. In addition, the passenger issued the hall call cannot issue another hall call until the crowded elevator starts moving and cannot know the condition of the next elevator beforehand. Therefore, in some cases one or more elevators pass through before the passenger can ride in a not-crowded elevator. However, according to the embodiment of this invention, the above prior art disadvantages are all eliminated.

In the embodiment of this invention described above, a candidate elevator is selected from a plurality of candidate elevators using the estimated arrival time as the control target. However, the control target is not limited only to the estimated arrival time, but it may be the cage crowded state degree, ride-in time, long waiting factor, reservation change factor, energy saving factor, guidance information amount, transportation efficiency or the like. Further, the comparison results of such control target values between elevators may be displayed on the guidance information display to assist a passenger in selecting an elevator.

Further in the embodiment of the present invention, the second candidate elevator has been selected on condition that the first candidate elevator does not satisfy the predetermined control target value. However, such condition may include the condition that the cage crowded state degree is less than a predetermined one as previously set at the particular hour of the daily schedule, the condition that the first candidate elevator does not satisfy the control target with the highest priority order among the predetermined plurality of control targets, the condition that a passenger issues a hall call using an ID card, oscillator or the like, and other conditions.

As appreciated from the foregoing description of the present invention, a passenger can select a call assigned elevator as desired. Therefore, a hall call resulting in a wasteful stop can be avoided beforehand at the crowded hour or in other cases, thus allowing handy method for use.

We claim:

1. An elevator group supervisory system comprising:
- a plurality of elevators for service to a plurality of floors;
- a hall calling unit provided at each elevator hall for calling said elevators;
- a cage calling unit provided in each cage of said elevators for designating a destination floor;
- a control unit responsive to a generated hall call for assigning one or more of said elevators;
- a display provided at each elevator hall for displaying call assigned elevator selection conditions selectable by a passenger; and
- a selection unit for selecting said displayed conditions.

2. An elevator group supervisory system comprising:
- a plurality of elevators for service to a plurality of floors;
- a hall calling unit provided at each elevator hall for calling said elevators;
- a cage calling unit provided in each cage of said elevators for designating a destination floor;
- a control unit responsive to a generated hall call for assigning one or more of said elevators;
- a display provided at each elevator hall for displaying information of an assigned elevator; and
- a unit for instructing a re-assignment request when a passenger is dissatisfied with said assigned elevator.

3. An elevator group supervisory system according to claim 1 or 2, wherein the information to be displayed on said display is information regarding the degree of crowded state in the cage of an elevator.

4. An elevator group supervisory system according to claim 1 or 2, wherein the information to be displayed on said display is information regarding a floor serviceable by an elevator.

5. An elevator group supervisory system according to claim 1, wherein said displayed conditions selection unit is said hall calling unit, wherein a condition is selected upon actuation of said hall calling unit while said conditions are displayed.

6. An elevator group supervisory system according to claim 1, wherein the information to be displayed is information regarding how an elevator is used by a passenger, and the degree of crowded state at an elevator hall.

7. An elevator group supervisory system comprising:
- a plurality of elevators for service to a plurality of floors;
- a hall calling button provided at each elevator hall;
- an operation control unit responsive to a signal inputted from said hall calling button for controlling assignment of a serviceable elevator;
- a guidance information display provided at each elevator hall;
- means for notifying the condition of each elevator by using said guidance information display provided at each elevator hall; and
- means for designating an elevator which a passenger wants to use.

8. An elevator group supervisory system according to claim 7, further comprising means for notifying that a serviceable elevator can be designated by a passenger at an elevator hall, by using said guidance information display.

9. An elevator group supervisory system according to claim 7 or 8, wherein the period during which a passenger can designate a serviceable elevator at an elevator hall is within a predetermined time after a hall call occurs.

10. An elevator group supervisory system according to claim 9, wherein said predetermined time is the time required, for an elevator having a shortest estimated arrival time to a floor calling said elevator, to reach and stop at said floor.

11. An elevator group supervisory system according to claim 7, further comprising means for making a hall call response lamp to flicker for the period during which a serviceable elevator can be designated at an elevator hall.

12. An elevator group supervisory system according to claim 7, wherein said guidance information display includes means for selectively notifying the conditions of a plurality of elevators, and said system further comprising means for assigning the elevator being notified at the time when said elevator designating means is actuated.

13. An elevator group supervisory system according to claim 7, further comprising means for making invalid said elevator designating means.

14. An elevator group supervisory system according to claim 7, wherein notifying a serviceable elevator is conducted by said guidance information display located nearest to said hall calling button by which a hall call was generated.

15. An elevator group supervisory system according to claim 7, wherein if said elevator designating means is not actuated, a hall call is assigned to an elevator a group supervisory controller has selected beforehand.

16. An elevator group supervisory system according to claim 7, wherein said elevator designating means is used also as said hall calling button.

17. An elevator group supervisory system according to claim 7, wherein for each of said plurality of elevators, the information regarding at least one of an estimated arrival time to a calling floor, the number of passengers allowed to ride in the cage, and an estimated ride-in time, is notified.

18. An elevator group supervisory system according to claim 7, wherein said guidance information is provided for each of said plurality of elevators, and after a call assigned elevator is selected, the operation information of said selected elevator is notified by said guidance information display of said selected elevator.

19. An elevator group supervisory system according to claim 18, wherein said guidance information display other than said guidance information display of said selected elevator notifies the information other than said operation information of said selected elevator.

20. An elevator group supervisory system according to claim 18, wherein said guidance information display other than said guidance information display of said selected elevator is intercepted to perform guidance notification.

* * * * *